US005229793A

United States Patent [19]

Hadimioglu et al.

[11] Patent Number: 5,229,793

[45] Date of Patent: Jul. 20, 1993

[54] LIQUID SURFACE CONTROL WITH AN APPLIED PRESSURE SIGNAL IN ACOUSTIC INK PRINTING

[75] Inventors: Babur B. Hadimioglu, Mountain View; Calvin F. Quate, Stamford; Butrus T. Khuri-Yakub, Palo Alto, all of Calif.

[73] Assignee: Xerox Corporation, Stamford, Conn.

[21] Appl. No.: 634,248

[22] Filed: Dec. 26, 1990

[51] Int. Cl.[5] ..... B41J 2/135

[52] U.S. Cl. ..... 346/140 R

[58] Field of Search ..... 346/140 R, 75; 367/157; 29/594, 609.1

[56] References Cited

U.S. PATENT DOCUMENTS

| | | | |
|---|---|---|---|
| 4,293,865 | 10/1981 | Jinnai et al. | 346/140 R |
| 4,308,547 | 12/1981 | Lovelady et al. | 346/140 R |
| 4,449,134 | 5/1984 | Skinner, Jr. | 346/75 |
| 4,719,476 | 1/1988 | Elrod et al. | 346/140 R |
| 4,751,530 | 6/1988 | Elrod et al. | 346/140 R |
| 4,973,980 | 11/1990 | Howkins et al. | 346/1.1 |
| 5,028,937 | 7/1991 | Khuri-Yakub et al. | 346/140 R |

FOREIGN PATENT DOCUMENTS

| | | |
|---|---|---|
| 5383770 | 1/1980 | Japan . |
| 60-97859 | 5/1985 | Japan . |

OTHER PUBLICATIONS

Naoki Morita, "Characteristics on Travelling Wave Drop Generator for Multi-Nozzle Continuous Ink Jet" 1989.

Naoki Morita, "Multinozzle Drop Generator for Continuous Ink Jet Printing", Part 2, vol. 7, Nov. 7, 1989.

*Primary Examiner*—Benjamin R. Fuller
*Assistant Examiner*—N. Le
*Attorney, Agent, or Firm*—Anglin & Giaccherini

[57] ABSTRACT

This invention is an acoustic ink printer. It has a pool of ink (33) with a free surface (36). Underneath the ink is a print head (10) which has droplet ejectors (14) for irradiating the free surface (36) of the pool of ink (33) with focused acoustic radiation (44). Over the free surface (36) of the pool of ink (33) is a membrane (16), with one or more apertures (20) aligned with the droplet ejectors (14), in intimate contact with the free surface (36) of the pool of ink (33). The apertures 20 are substantially larger than the waist diameter (46) of the focused acoustic radiation (44). An external pressure source (50) maintains the meniscus (48) of the pool of ink (33) substantially in the focal plane (52) of the focused acoustic radiation (44) during operation of the droplet ejectors (14). A piezoelectric crystal (24) is in intimate contact with the pool of ink (33). An electrical signal source (32) energizes the piezoelectric crystal (24) in order to apply a pressure signal (54) on demand to the pool of ink (33) during operation of the droplet ejectors (14). The different pressure signals (54) resulting from application of different electrical signals (29) to the piezoelectric crystal (24) can be utilized to eject individual droplets (38) of ink (33) from the free surface (34) of the ink (33) on demand, or to effect finer control over the free surface (34) of the ink (33) than is possible with the external pressure source (50) by itself.

3 Claims, 2 Drawing Sheets

LIQUID SURFACE CONTROL WITH AN APPLIED PRESSURE SIGNAL IN ACOUSTIC INK PRINTING

BACKGROUND OF THE INVENTION

The present invention relates to the field of acoustic ink drop printers and, more particularly, to methods and apparatus for finely controlling the ink levels in the print heads of such printers.

Acoustic ink printing has been identified as a promising technology for manufacturing printers. The technology is still in its infancy but it may become an important alternative to ink jet printing because it avoids the nozzles and small ejection orifices that have caused many of the reliability and accuracy problems that are experienced with ink jet printers. The basic principles of this technology have been described in a series of U.S. Patent Nos., including: U.S. Pat. Nos. 4,308,547, "Liquid Drop Emitter", by Lovelady et al.; 4,751,530, "Acoustic Lens Array for Ink Printing", by Elrod et al.; 4,751,529, "Microlenses for Acoustic Printing", by Elrod el.; and 4,751,534, "Planarized Printheads for Acoustic Printing", by Elrod et al.

The print head in an acoustic ink printer comprises a pool of ink, a series of spatially aligned droplet ejectors and a mechanism for maintaining the surface of the ink at a desired level. When activated by an appropriate electrical signal, the droplet ejectors irradiate the surface of the ink with a beam of focused acoustic radiation thus forcing ink droplets to be ejected from the surface of the ink. The droplets are then captured on a nearby recording medium.

Experiments have shown that the position of the surface of the ink is critical to the success of the ink drop ejection process. The surface of the ink must remain within the effective depth of focus of the droplet ejectors. A great deal of effort has been devoted methods of controlling the surface of the ink. Elrod et al., in their U.S. patent application Ser. No. 07/287791 for "Acoustic Ink Printers Having Reduced Focusing Sensitivity" disclose a technique for suppressing the half wave resonances in the resonant acoustic cavities.

In another U.S. patent application filed on Dec. 19, 1986, entitled "Variable Spot Size Acoustic Printing", Elrod et. al suggest using a closed loop servo system for increasing and decreasing the level of the ink surface by utilizing an error signal which is produced by comparing the output voltages from the upper and lower halves of a split photodetector. The magnitude and sense of that error signal are then correlated with the free ink surface level via a laser beam reflected off the ink surface. While this is a workable solution to the problem, it is expensive to implement and the photodetector and laser beam must be kept in precise optical alignment.

Ink transport mechanisms have also been proposed in U.S. Pat. No. 4,801,953, "Perforated Ink Transports for Acoustic Ink Printing", by Quate; and U.S. Pat. No. 4,797,693, "Polychromatic Acoustic Ink Printing", by Quate. However, the free surface level control that is provided by these transport mechanisms is dependent upon the uniformity of the remote inking process and upon the dynamic uniformity of the ink transport process.

Finally, a perforated membrane has been devised which, in combination with a device for pressurizing the ink to an essentially constant bias pressure, maintains the surface of the ink more nearly within the effective depth of focus of the acoustic beams. The details of this membrane are revealed in U.S. patent application Ser. No. 07/358,752, "Perforated Membranes for Liquid Level Control In Acoustic Ink Printing", by Khuri-Yakub et al.

It can readily be seen that improvements in liquid level control would fill a long felt need in the field of acoustic ink drop printing.

SUMMARY OF THE INVENTION

This invention builds upon prior developments relating to the use of focused acoustic radiation for ejecting ink droplets on demand from a free ink surface at sufficient velocity to deposit them in an image configuration on a nearby recording medium.

This invention is an acoustic ink printer. It has a pool of ink with a free surface. Underneath the ink is a print head which has depressions or droplet ejectors for irradiating the free surface of the pool of ink with focused acoustic radiation. Over the surface of the pool of ink is a membrane, with one or more apertures aligned with the droplet ejectors, in intimate contact with the free surface of the pool of ink. The apertures are substantially larger than the waist diameter of the focused acoustic radiation. An external pressure source maintains the meniscus of the ink substantially in the focal plane of the focused acoustic radiation during operation.

A distinction must be made between the focused acoustic radiation in the form of a high frequency sound wave in the liquid and the pressure pulse introduced by the piezoelectric crystal in intimate contact with the pool of ink. An electrical signal energizes the piezoelectric crystal which applies a pressure pulse to the pool of ink. This pressure can dynamically control the surface of the ink in the membrane apertures. Control of the liquid level in this way can be utilized for two different purposes. First, the different pressure signals resulting from the application of different electrical signals to the piezoelectric crystal can be used for fine control of the surface of the pool of ink. This is a more refined method of control than use of the pressure source operating by itself. Secondly, the different pressure signals resulting from the application of different electrical signals to the piezoelectric crystal can be utilized to eject individual droplets of ink from the free surface of the ink. This is done by using the pressure pulse to move the level of the ink to the focal plane of the focused acoustic radiation that emanates from the droplet ejectors.

The different pressure signals resulting from application of different electrical signals to the piezoelectric crystal can be utilized to eject individual droplets of ink from the free surface of the ink on demand, or to effect finer control over the free surface of the ink than is possible with the external pressure source by itself.

An appreciation of the other aims and objectives of the present invention and a more complete and comprehensive understanding of this invention may be achieved by studying the following description of a preferred embodiment and by referring to the accompanying drawings.

DETAILED DESCRIPTION OF THE PREFERRED EMBODIMENT

Figure 1:
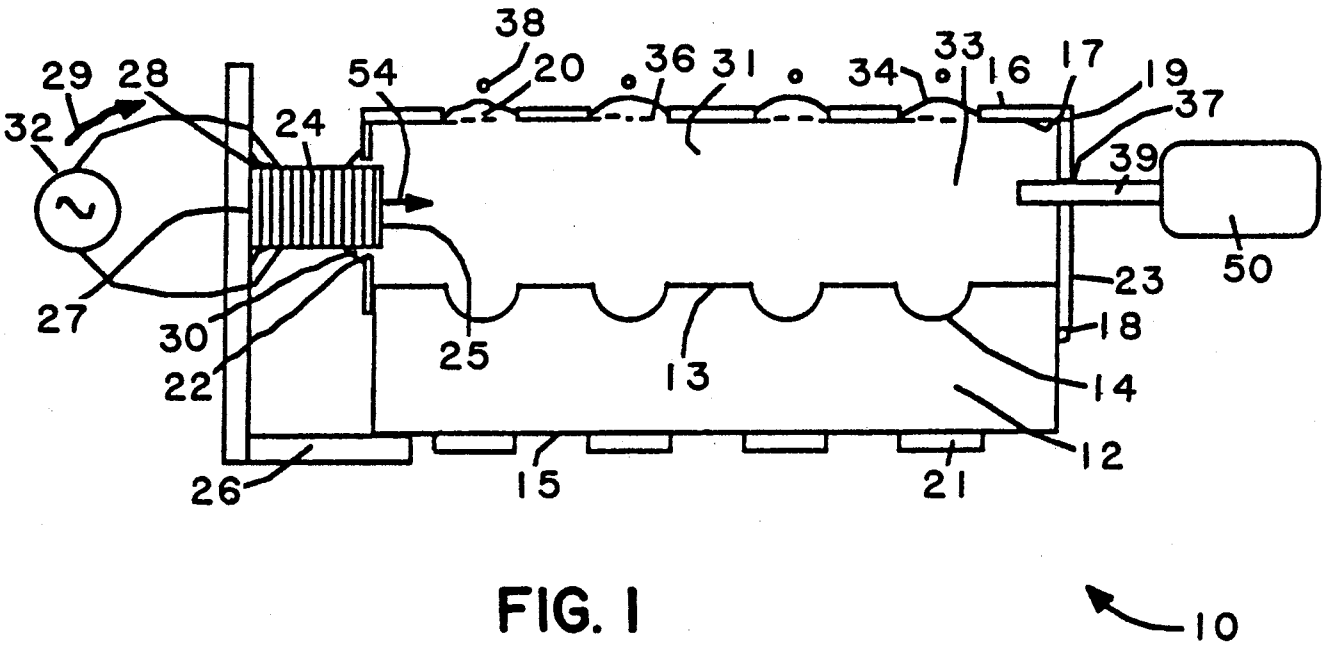
FIG. 1 is a cross-section of a typical print head.

FIG. 1 shows a typical cross-section of a print head 10 constructed in accordance with this invention. The print head 10 comprises a base 12 with a series of depressions 14 in its upper surface 13. A top 16, which is shaped like an open sided box, is fastened over the top surface 13 of the base 12. The top comprises an upper member 19 and four side members 23. In the preferred embodiment, the top 16 is adhesively bonded to the base 12 with an adhesive 18. However, other fastening methods, which create a liquid-tight seal could be used. The cavity 31 between the top 16 and the base 12 is filled with an ink 33. In the upper member 19 of the top 16 is one or more apertures 20. The apertures 20, are aligned with the depressions 14 in the base 12. The apertures 20 are small enough so that surface tension prevents the ink 33 from escaping from the cavity 31.

Fastened to the lower surface 15 of the base 12 are a series of transducers 21. These transducers 21 are also aligned with the depressions 14 in the upper surface 13 of the base 12.

Through one of the side members 23 is an aperture 22. Protruding through this aperture 22 is a the free end 25 of a piezoelectric crystal 24. Any material that has piezoelectric properties can be used. However, in the preferred embodiment this piezoelectric crystal 24 is made from lead zirconate titanate (PZT). In another embodiment it could be a multilayer piezoelectric element conventionally used to achieve large excursions with a minimum of voltage applied to the crystal from the electrical signal source. The crystal is sealed into the opening with an adhesive 30. The other end 27 of the piezoelectric crystal is fixed to a relatively heavy support 26, which is also fastened to the print head base 12. In the preferred embodiment, the piezoelectric crystal 24 is adhesively bonded to the support 26 with a rigid adhesive 28. Electrically connected to the piezoelectric crystal 24 is a signal source 32, which transmits a voltage or signal 29 to the crystal 24.

Through another side member 23 of the top 16 is another opening 37. Through this opening protrudes a tube 39. At the other end of the tube is the pressure source 50 for the ink 33. Under pressure from the pressure source 50, the ink 33 assumes a position approximately as shown at 36 on FIG. 1. This is called the free surface 36 of the ink 33.

Figure 2:
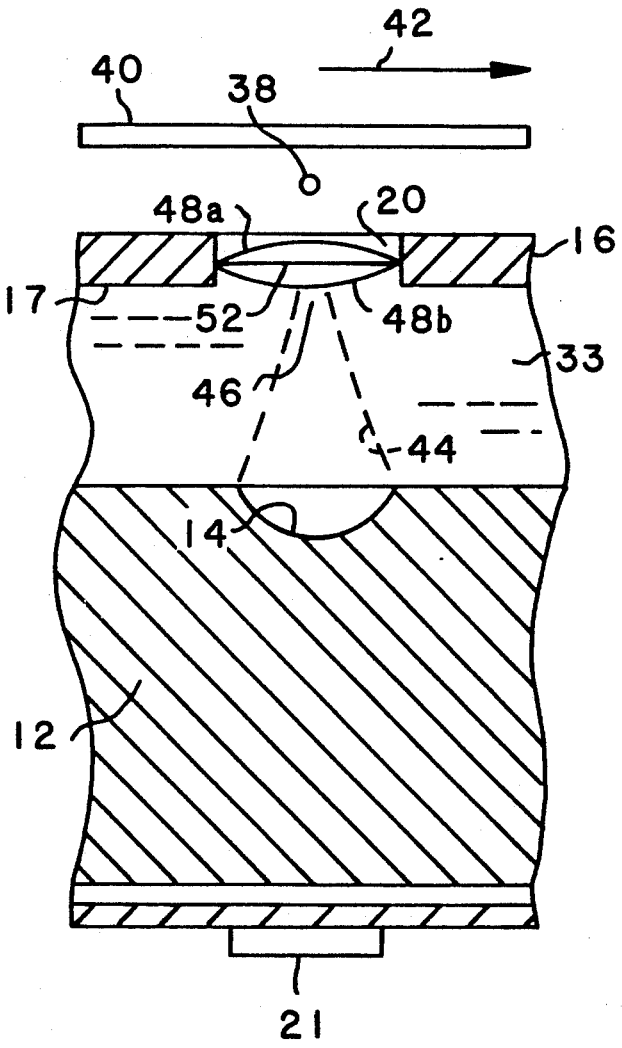
FIG. 2 is a partial cross-section of a typical print head, focusing on one section in order to better show some details of operation.

FIG. 2 shows one segment of the print head 10 in order to better demonstrate some features of its operation. Because of capillary action, the free surface of the ink 36 may assume a meniscus position between 48*a* and 48*b* on FIG. 2. When the transducer 21 is energized with radio frequency energy at about 100 to 200 MHz, it applies an acoustic signal to the base 12. This signal travels through the base 12 and is converted into a spherical wave in the liquid at the depression 14. This depression 14 projects a converging beam 44 of acoustic energy towards the free surface 36 of the ink 33. When the acoustic signal reaches the free surface 36 of the ink 33 it ejects a droplet of ink 38, through the aperture 20 in the top 16, towards the recording medium 40. The ink droplets 38 travel at about 1 to several m/sec. In the preferred embodiment the recording medium 40 is paper. The recording medium 40 may be travelling past the print head as indicated by the arrow 42 on FIG. 2.

The waist diameter 46 of the focused acoustic beam 44 is about 8 $\mu$, which is considerably smaller than the aperture 20, so the aperture 20 has no material effect on the size of the droplet 38 that is ejected. The free surface 36 of the ink 33 must be close to the focal plane 52 of the focused acoustic beam 44 in order for the energy of the beam to effectively eject a droplet 38 of ink 33.

The improvement represented by this invention can be best understood by referring to FIGS. 1 and 2 together. When a voltage 29 is applied by the signal source 32 to the piezoelectric crystal 24, the crystal 24 will expand and send a pressure pulse into the ink 33. The crystal is constrained by the support 26 so that it can only expand into the cavity 31 and displace the ink 33. The height to which the ink surface 34 rises is proportional to the expansion 54 of the piezoelectric crystal 24 and thus to the magnitude of the applied voltage. This improvement can be used for several applications such as switching, that is turning droplet section on and off or fine liquid level control. For switching, application of the voltage 29 to the piezoelectric crystal 24 raises the surface 34 of the ink 33 out of the focal plane 52 of the focused acoustic beam 44, thus stopping droplet 38 ejection. For fine liquid level control, a smaller voltage 29 is applied to the crystal 24 on demand to keep the ink surface 34 precisely at or very close to the focal plane 54 of the focused acoustic beam 44. This enables closer control of the placement of the ink surface 34 than is possible with the pressure source 50 alone.

It is possible to take advantage of capillary waves to assist in controlling the surface 34 of the ink 33. If the applied voltage 29 is sinusoidal, the resulting pressure signal 54 will also be sinusoidal. In the preferred embodiment, the piezoelectric crystal is excited to vibrate in the range of about 1 to 20 kHz. This will set up capillary waves in the apertures 20 which will propagate from the centers to the walls of the apertures 20 where they will be reflected. The frequency of the applied voltage can be adjusted so that maximum displacement is obtained at the centers of the apertures 20. At this point, the frequency of the piezoelectric pressure pulses matches the natural aperture frequency.

When this technique is applied for switching, the radio frequency pulses applied to the transducers 21 are synchronized with the frequency of the piezoelectric drive signal 29. To eject droplets 38, the phase of the piezoelectric drive signal 29 is adjusted so that the surface 34 of the ink 33 is in the focal plane 54 when the acoustic signal 44 arrives. To stop droplet 38 ejection, the phase of the piezoelectric signal 29 is changed so that the surface 34 of the ink 33 is out of the focal plane 54 when the acoustic signal 44 arrives.

It should be noted that the frequency of the piezoelectric drive signal 29 is not limited to the aperture resonance frequency. If frequencies different from the resonance frequency, off resonance frequencies, are utilized the height of the surface 34 of the ink 33 will be less. However, switching response will be faster since at off-resonance frequencies, the ink surface 34 collapses within a cycle to a lower level.

There is another way to utilize the improvement represented by this invention. This method may be used if the surface velocity imparted to the surface 34 of the ink 33 by the pressure signal 54 is equal to or larger than the ejection velocity of the droplets 38. If the surface velocity is in the same direction as the direction of the ejected droplets 38, the two velocities will add. If the surface velocity is in the opposite direction, the two velocities will cancel and no droplets 38 will be ejected.

For example, let us assume the droplet ejection velocity is 2 m/sec. If the crystal drive frequency is 20 kHz and surface motion is about 10 μm, then surface velocity will be about 2 m/sec., which can effectively double or cancel droplet ejection, thus accomplishing switching.

From the foregoing descriptions it will be appreciated that this invention represents a substantial improvement in the field of acoustic ink printing. It enables finer control and alternate methods of switching than were available before. Although the present invention has been described in detail with reference to a particular preferred embodiment, persons possessing ordinary skill in the art to which this invention pertains will appreciate that various modifications and enhancements may be made without departing from the spirit and scope of the claims that follow.

LIST OF REFERENCE NUMERALS

| | |
|---|---|
| 10 | Print head |
| 12 | Print head base |
| 13 | Upper surface of base |
| 14 | Droplet ejector |
| 15 | Lower surface of base |
| 16 | Print head top |
| 17 | Inner surface of print head top |
| 19 | Upper member of top |
| 18 | Adhesive bonding top to base |
| 20 | Ink ejection aperture |
| 21 | Transducer |
| 22 | Aperture for piezoelectric crystal |
| 23 | Side member of top |
| 24 | Piezoelectric crystal |
| 25 | Free end of piezoelectric crystal |
| 26 | Piezoelectric base |
| 27 | Fixed end of piezoelectric crystal |
| 28 | Adhesive bonding piezoelectric crystal to its base |
| 29 | Piezoelectric voltage or drive signal |
| 30 | Flexible seal |
| 31 | Cavity |
| 32 | Signal source for piezoelectric crystal |
| 33 | Ink |
| 34 | Ink surface under influence of pressure pulse from piezoelectric crystal |
| 36 | Ink surface without pressure pulse from piezoelectric crystal |
| 37 | Ink supply aperture |
| 38 | Ink droplet |
| 39 | Tube leading to ink supply |
| 40 | Recording medium |
| 42 | Direction of motion |
| 44 | Focused acoustic beam |
| 46 | Waist diameter of focused acoustic beam |
| 48a,b | Meniscus positions |
| 50 | External pressure source |
| 52 | Focal plane of focused acoustic beam |
| 54 | Pressure signal |

What is claimed is:

1. In an apparatus with an acoustic ink printer having a pool of ink (33) with a free surface (36); a print head (10) including a printhead base (12); a transducer (21); a droplet ejector (14) for irradiating said free surface (36) of said pool of ink (33) with a focused acoustic radiation (44) to eject a droplet (38) from said free surface (36) of said pool of ink (33) on demand, said focused acoustic radiation (44) being brought to focus with a finite waist diameter (46) in a focal plane (52); a membrane (16) having an inner surface (17) in intimate contact with said free surface (36) of said pool of ink (33), said membrane (16) having an aperture (20) passing through said membrane, said aperture (20) being substantially larger than said waist diameter (46) of said acoustic radiation (44), said free surface (36) of said pool of ink (33) forming a meniscus (48) across said aperture (20); and an external pressure source (50) for maintaining said meniscus (48) substantially in said focal plane (52) during operation of said droplet ejector (14);

the improvement for dynamically controlling said free surface (36) in said aperture (20) of said membrane (16) with extreme precision with respect to said focal plane (52) comprising:

a support (26), fastened to said printhead base (12);

a piezoelectric crystal (24) in intimate contact with said pool of ink (33); said piezoelectric crystal (24) having a free end (25) and a fixed end (27); said fixed end (27) being fastened to said support (26); and an electrical signal source (32), electrically connected to said piezoelectric crystal (24);

said electrical signal source (32) and said piezoelectric crystal (24) in combination applying a pressure signal (54) on demand to said pool of ink (33) during operation of said droplet ejector (14);

said printhead base (12) having an upper surface (13) and a lower surface (15); said droplet ejector (14) being located in said upper surface (13); said transducer (21) being affixed to said lower surface (15);

said focused acoustic radiation (44) being produced by energizing said transducer (21) with radio frequency energy.

2. The apparatus of claim 1 in which said pressure signal (54) is in resonance with said focused acoustic radiation (44).

3. The apparatus of claim 1 in which said pressure signal (54) is nearly resonant with said focused acoustic radiation (44).

* * * * *